US007730901B2

(12) United States Patent
Ball

(10) Patent No.: US 7,730,901 B2
(45) Date of Patent: Jun. 8, 2010

(54) HYDRANT ROOF MOUNT

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 322 days.

(21) Appl. No.: 11/836,696

(22) Filed: Aug. 9, 2007

(65) Prior Publication Data

US 2008/0006327 A1 Jan. 10, 2008

Related U.S. Application Data

(63) Continuation-in-part of application No. 29/248,316, filed on Aug. 9, 2006, now Pat. No. Des. 574,065, and a continuation-in-part of application No. 11/554,232, filed on Oct. 30, 2006, now Pat. No. 7,472,718.

(60) Provisional application No. 60/821,892, filed on Aug. 9, 2006, provisional application No. 60/596,962, filed on Nov. 1, 2005.

(51) Int. Cl.
*E03B 9/02* (2006.01)

(52) U.S. Cl. ..... 137/15.17; 137/295; 137/360

(58) Field of Classification Search ..... 137/295, 137/272, 292, 283, 284, 357, 360, 15.17
See application file for complete search history.

(56) References Cited

U.S. PATENT DOCUMENTS

| | | | | |
|---|---|---|---|---|
| 21,858 | A | 10/1858 | Swan | |
| 53,944 | A * | 4/1866 | Biggs et al. | 137/292 |
| 244,804 | A | 7/1881 | Gillespie | |
| 556,500 | A | 3/1896 | Fox | |
| 610,470 | A | 9/1898 | Buehler | |
| 616,542 | A | 12/1898 | Koehne | |
| 695,147 | A | 3/1902 | Denney | |
| 695,311 | A | 3/1902 | Hickey | |
| 926,185 | A | 6/1909 | Hayes | |
| 934,188 | A | 9/1909 | Kirby | |
| 962,294 | A | 6/1910 | Armington | |
| 1,021,537 | A | 3/1912 | Lawnin | |
| 1,069,003 | A | 7/1913 | Haennig | |
| 1,310,521 | A | 7/1919 | Crall | |
| 1,426,407 | A | 8/1922 | Pennington | |
| 1,433,110 | A | 10/1922 | Buckler | |
| 1,556,241 | A | 10/1925 | Mueller | |
| 1,570,180 | A | 1/1926 | Pulliam | |
| 1,621,905 | A | 3/1927 | Russell | |

(Continued)

OTHER PUBLICATIONS

International Search Report for International (PCT) Patent Application No. PCT/US07/75636, mailed Jun. 10, 2008.

(Continued)

*Primary Examiner*—Kevin L Lee
(74) *Attorney, Agent, or Firm*—Sheridan Ross P.C.

(57) ABSTRACT

A system for securing a hydrant to a roof of a building is provided that includes a hydrant support that rigidly interconnects to the roof deck. In addition, a method of sealingly interconnecting a standpipe of the hydrant to the hydrant support is provided wherein a plurality of seals are employed. In order to enhance the seal provided between the standpipe and a hydrant support, a boot may be used that covers the interface between the standpipe and the hydrant support.

23 Claims, 12 Drawing Sheets

U.S. PATENT DOCUMENTS

| | | | | |
|---|---|---|---|---|
| 1,774,307 | A | | 8/1930 | Willig |
| 1,828,763 | A | | 10/1931 | Carnes |
| 1,936,669 | A | | 11/1933 | Heeter |
| 2,025,067 | A | | 12/1935 | Miller |
| 2,072,427 | A | | 3/1937 | O'Brien |
| 2,077,021 | A | | 4/1937 | Sites |
| 2,097,733 | A | * | 11/1937 | Miller ..... 137/292 |
| 2,140,829 | A | | 12/1938 | Child |
| 2,329,960 | A | | 9/1943 | Verheul |
| 2,429,940 | A | | 10/1947 | McDaniel |
| 2,484,063 | A | | 10/1949 | Ackley |
| 2,498,395 | A | | 2/1950 | Coss |
| 2,574,625 | A | | 11/1951 | Coss |
| 2,580,199 | A | | 12/1951 | Schmid |
| 2,583,956 | A | | 1/1952 | Lindsay et al. |
| 2,598,488 | A | | 5/1952 | Bart |
| 2,599,325 | A | | 6/1952 | Fritzberg |
| 2,605,781 | A | | 8/1952 | Schmid et al. |
| 2,629,402 | A | | 2/1953 | Cook |
| 2,652,224 | A | | 9/1953 | Noland |
| 2,664,096 | A | | 12/1953 | Murdock et al. |
| 2,675,825 | A | | 4/1954 | Hobbs et al. |
| 2,688,976 | A | | 9/1954 | Baker |
| 2,708,449 | A | | 5/1955 | Keithley |
| 2,730,326 | A | | 1/1956 | Staben |
| 2,949,933 | A | | 8/1960 | Moen |
| 2,986,341 | A | | 5/1961 | Goodrie |
| 2,997,054 | A | | 8/1961 | Woodford |
| 3,014,667 | A | | 12/1961 | McLean et al. |
| 3,023,767 | A | | 3/1962 | Woodford |
| 3,029,603 | A | | 7/1962 | Ackroyd |
| 3,056,418 | A | | 10/1962 | Adams et al. |
| 3,017,896 | A | | 11/1962 | Papacek |
| 3,070,116 | A | | 12/1962 | Noland et al. |
| 3,146,142 | A | | 8/1964 | Maly |
| 3,150,383 | A | | 9/1964 | Reich |
| 3,162,407 | A | | 12/1964 | Yax |
| 3,244,192 | A | | 4/1966 | Noland |
| 3,283,093 | A | | 11/1966 | Bishop |
| 3,348,862 | A | | 10/1967 | Leopold, Jr. et al. |
| 3,380,464 | A | | 4/1968 | Arterbury |
| 3,384,113 | A | | 5/1968 | Pennisi |
| 3,390,898 | A | | 7/1968 | Sumida |
| 3,392,745 | A | | 7/1968 | Noland |
| 3,407,837 | A | | 10/1968 | Fulton et al. |
| 3,414,001 | A | | 12/1968 | Woodford |
| 3,416,555 | A | | 12/1968 | Chapou |
| 3,424,189 | A | | 1/1969 | Woodford |
| 3,429,596 | A | | 2/1969 | Marshall |
| 3,480,027 | A | | 11/1969 | Noland |
| 3,543,786 | A | | 12/1970 | Woodford |
| 3,612,584 | A | | 10/1971 | Taylor |
| 3,638,680 | A | | 2/1972 | Kopp |
| 3,679,241 | A | | 7/1972 | Hoffmann |
| D227,365 | S | | 6/1973 | Woodfield |
| D227,366 | S | | 6/1973 | Woodfield |
| 3,818,874 | A | | 6/1974 | Tria |
| 3,885,585 | A | | 5/1975 | Carpentier |
| D236,892 | S | | 9/1975 | Carlson |
| 3,913,602 | A | | 10/1975 | Yoon |
| 3,952,770 | A | | 4/1976 | Botnick |
| 3,983,896 | A | | 10/1976 | Harrington |
| 4,008,732 | A | | 2/1977 | Fichter et al. |
| D244,605 | S | | 6/1977 | Ratnik |
| 4,034,174 | A | | 7/1977 | McCord |
| 4,093,280 | A | | 6/1978 | Yoshizawa et al. |
| 4,103,941 | A | | 8/1978 | Stoll |
| 4,109,671 | A | | 8/1978 | Hughes et al. |
| 4,112,966 | A | | 9/1978 | Carlson |
| 4,117,856 | A | | 10/1978 | Carlson |
| 4,134,424 | A | | 1/1979 | Zeyra et al. |
| 4,158,366 | A | | 6/1979 | Van Meter |
| 4,178,956 | A | | 12/1979 | Fillman |
| 4,182,356 | A | | 1/1980 | Woodford, Sr. |
| 4,209,033 | A | | 6/1980 | Hirsch et al. |
| 4,212,319 | A | | 7/1980 | Krablin |
| 4,266,813 | A | | 5/1981 | Oliver |
| 4,281,857 | A | | 8/1981 | Randall |
| 4,286,616 | A | | 9/1981 | Botnick |
| 4,300,593 | A | | 11/1981 | Ritter |
| 4,316,481 | A | | 2/1982 | Fillman |
| 4,429,422 | A | | 2/1984 | Wareham |
| D275,512 | S | | 9/1984 | Shaw |
| 4,483,361 | A | | 11/1984 | Jungbert, Sr. |
| 4,503,877 | A | | 3/1985 | Ward et al. |
| 4,577,653 | A | | 3/1986 | Marty |
| D284,302 | S | | 6/1986 | Hammarstedt |
| 4,609,006 | A | | 9/1986 | Parkison et al. |
| 4,619,287 | A | | 10/1986 | Hama et al. |
| 4,649,959 | A | | 3/1987 | Wadleigh |
| 4,653,521 | A | | 3/1987 | Fillman et al. |
| 4,653,522 | A | | 3/1987 | Fillman et al. |
| 4,655,486 | A | | 4/1987 | Tarnay et al. |
| 4,700,732 | A | | 10/1987 | Francisco |
| 4,703,956 | A | | 11/1987 | Keech |
| 4,712,812 | A | | 12/1987 | Weir, III |
| D297,971 | S | | 10/1988 | Kiyota et al. |
| 4,776,362 | A | | 10/1988 | Domingue et al. |
| 4,784,303 | A | | 11/1988 | Ahad et al. |
| 4,790,573 | A | | 12/1988 | Cardozo |
| 4,798,221 | A | | 1/1989 | Crawford et al. |
| 4,821,762 | A | | 4/1989 | Breneman |
| 4,821,763 | A | | 4/1989 | Ackroyd et al. |
| 4,854,339 | A | | 8/1989 | Hoeptner, III |
| 4,884,725 | A | | 12/1989 | Ahad et al. |
| 4,909,270 | A | | 3/1990 | Enterante, Sr. et al. |
| 4,937,559 | A | | 6/1990 | Meacham et al. |
| 4,946,434 | A | | 8/1990 | Plaisted et al. |
| 4,964,657 | A | | 10/1990 | Gonzales |
| 5,024,419 | A | | 6/1991 | Mulvey |
| 5,029,603 | A | | 7/1991 | Ackroyd |
| 5,033,500 | A | | 7/1991 | Hoeptner, III |
| 5,050,632 | A | | 9/1991 | Means, Jr. |
| 5,054,517 | A | | 10/1991 | Liesenhoff et al. |
| 5,058,627 | A | | 10/1991 | Brannen |
| 5,109,929 | A | | 5/1992 | Spears |
| 5,135,028 | A | | 8/1992 | Rickenbach et al. |
| 5,160,179 | A | | 11/1992 | Takagi |
| 5,195,785 | A | | 3/1993 | Jellison |
| 5,205,325 | A | | 4/1993 | Piper |
| 5,217,040 | A | | 6/1993 | Hochstrasser |
| 5,226,629 | A | | 7/1993 | Millman et al. |
| 5,241,981 | A | | 9/1993 | Ahern |
| 5,246,028 | A | | 9/1993 | Vandepas |
| 5,261,441 | A | | 11/1993 | Anderson |
| 5,284,582 | A | | 2/1994 | Yang |
| 5,366,257 | A | | 11/1994 | McPherson et al. |
| 5,392,805 | A | | 2/1995 | Chrysler |
| 5,394,572 | A | | 3/1995 | Humphreys |
| 5,399,173 | A | | 3/1995 | Parks et al. |
| 5,437,481 | A | | 8/1995 | Spears et al. |
| 5,482,329 | A | | 1/1996 | McCall et al. |
| 5,496,076 | A | | 3/1996 | Lin |
| 5,551,473 | A | | 9/1996 | Lin et al. |
| 5,555,907 | A | | 9/1996 | Philipp |
| 5,590,679 | A | | 1/1997 | Almasy et al. |
| 5,603,347 | A | | 2/1997 | Eaton |
| 5,632,303 | A | | 5/1997 | Almasy et al. |
| 5,649,723 | A | | 7/1997 | Larsson |
| 5,653,254 | A | | 8/1997 | Condon et al. |
| 5,690,141 | A | | 11/1997 | Creaghe |
| 5,701,925 | A | | 12/1997 | Mulligan et al. |
| 5,740,831 | A | | 4/1998 | DeNardo et al. |
| 5,752,542 | A | | 5/1998 | Hoeptner, III |

| | | | | |
|---|---|---|---|---|
| 5,788,443 | A | 8/1998 | Cabahug | |
| 5,813,428 | A | 9/1998 | Almasy et al. | |
| 5,890,241 | A | 4/1999 | Ball | |
| 5,906,341 | A | 5/1999 | Brown | |
| 5,911,240 | A | 6/1999 | Kolar et al. | |
| 5,961,095 | A | 10/1999 | Schroff | |
| 5,964,246 | A | 10/1999 | Meeker | |
| D421,092 | S | 2/2000 | Martin | |
| 6,041,611 | A | 3/2000 | Palmer | |
| 6,047,723 | A | 4/2000 | Hoeptner, III | |
| 6,132,138 | A | 10/2000 | Haese | |
| 6,135,359 | A | 10/2000 | Almasy et al. | |
| 6,142,172 | A | 11/2000 | Schuler et al. | |
| 6,186,558 | B1 | 2/2001 | Komolrochanaporn | |
| D439,311 | S | 3/2001 | Martin | |
| 6,206,039 | B1 | 3/2001 | Schuler et al. | |
| 6,247,491 | B1 | 6/2001 | Petryna | |
| 6,338,364 | B1 | 1/2002 | Mendenhall | |
| 6,363,960 | B1 | 4/2002 | Gauss | |
| 6,427,716 | B1 | 8/2002 | Hoeptner, III | |
| 6,431,204 | B1 | 8/2002 | Ball | |
| 6,447,017 | B1 | 9/2002 | Gilbreath et al. | |
| 6,464,266 | B1 | 10/2002 | O'Neill et al. | |
| 6,467,752 | B2 | 10/2002 | Woods | |
| D470,915 | S | 2/2003 | Ball | |
| 6,517,124 | B1 | 2/2003 | Le Quere | |
| 6,526,701 | B2 * | 3/2003 | Stearns et al. | 52/24 |
| 6,532,986 | B1 | 3/2003 | Dickey et al. | |
| D473,631 | S | 4/2003 | Lai | |
| 6,550,495 | B1 | 4/2003 | Schulze | |
| 6,631,623 | B1 | 10/2003 | Ball | |
| D482,431 | S | 11/2003 | Ball | |
| 6,678,903 | B1 | 1/2004 | Rhodes | |
| 6,679,473 | B1 | 1/2004 | Ball | |
| 6,769,446 | B1 | 8/2004 | Ball et al. | |
| 6,805,154 | B1 | 10/2004 | Dickey et al. | |
| 6,857,442 | B1 | 2/2005 | Ball et al. | |
| 6,860,523 | B2 | 3/2005 | O'Neill et al. | |
| 6,880,573 | B2 | 4/2005 | Berkman et al. | |
| 6,883,534 | B2 | 4/2005 | Ball et al. | |
| 6,948,509 | B1 | 9/2005 | Ball et al. | |
| 6,948,518 | B1 | 9/2005 | Ball | |
| D521,113 | S | 5/2006 | Ball | |
| RE39,235 | E | 8/2006 | Schuler et al. | |
| 7,100,637 | B1 | 9/2006 | Ball | |
| 7,111,875 | B2 | 9/2006 | Ball | |
| 7,143,779 | B2 | 12/2006 | Parker | |
| 7,234,732 | B2 | 6/2007 | Ball | |
| 7,314,057 | B2 | 1/2008 | Parker | |
| D574,065 | S | 7/2008 | Ball | |
| 2001/0003350 | A1 | 6/2001 | Gandy et al. | |
| 2002/0189674 | A1 | 12/2002 | Meeder | |
| 2003/0111840 | A1 | 6/2003 | O'Neill et al. | |
| 2006/0108804 | A1 | 5/2006 | Ball | |
| 2006/0196561 | A1 | 9/2006 | Ball | |
| 2006/0254647 | A1 | 11/2006 | Ball | |
| 2007/0039649 | A1 | 2/2007 | Ball | |
| 2007/0044838 | A1 | 3/2007 | Ball | |
| 2007/0044840 | A1 | 3/2007 | Ball et al. | |
| 2007/0095396 | A1 | 5/2007 | Ball | |

OTHER PUBLICATIONS

Written Opinion for International (PCT) Patent Application No. Application No. PCT/US07/75636, mailed Jun. 10, 2008.
MPH-24 Pedestal Hydrant, MAPA Products, May 2002, 2 pages.
MPH-24D Pedestal Hydrant, MAPA Products, Apr. 2007, 1 page.
MPH-24FP Pedestal Hydrant, MAPA Products, Jan. 2004, 1 page.
MPH-24 Pedestal Hydrant, MAPA Products, Jan. 2004, 1 page.

* cited by examiner

HYDRANT ROOF MOUNT

This application claims the benefit of U.S. Provisional Patent Application Ser. No. 60/821,892, filed Aug. 9, 2006, the entire disclosure of which is incorporated by reference herein. This application is also a Continuation-In-Part of U.S. Design patent application Ser. No. 29/248,316, filed Aug. 9, 2006, now U.S. Pat. No. D,574,065, which is incorporated by reference in its entirety herein. This application is also a Continuation-In-Part of U.S. patent application Ser. No. 11/554,232, filed Oct. 30, 2006, now U.S. Pat. No. 7,472,718, which claims the benefit of U.S. Provisional Patent Application Ser. No. 60/596,962, filed Nov. 1, 2005, both disclosures of which being incorporated by reference in their entirety herein.

FIELD OF THE INVENTION

Embodiments of the present invention generally relate to a system for interconnecting a hydrant to the roof of a building or other structure.

BACKGROUND OF THE INVENTION

There is a growing need for a convenient and robust water source for, among other things, cleaning condenser coils and washing windows in buildings. Often hydrant and faucets are used on roofs but suffer from leaking and possess little structural support to accommodate the movement of a hose, for example. To try to address this issue, water faucets or hydrants are currently integrated into roof top penthouses, secured to a box, or secured to a bollard, methods of providing a water source that have many drawbacks. For example, the penthouse structure may not offer sufficient support, the attachment scheme may be prone to leaks, freeze protection may be insufficient, and/or the attachment location may not be in close proximity to the required areas of use. In addition, the prior art systems are often heavy and difficult to interconnect and they also provide unacceptable leak paths into the structure. Therefore, a need exists for a hydrant that can be sealingly mounted generally on a roof and yet substantially impervious to freezing.

Thus it is a long felt need to provide a water access system to the roof of a building that is easy to install and that is substantially leak and freeze proof. The following disclosure describes a device that provides structural support to roof-top hydrant system.

SUMMARY OF THE INVENTION

It is one aspect to provide a support for interconnection to a roof that secures a hydrant. More specifically, one embodiment of the present invention is a hydrant support that interconnects to a roof deck of a building that includes a weather-tight sealing system that interfaces with the standpipe of a traditional hydrant. The contemplated mount includes a vertically-oriented hydrant support having a flange for interconnection to the roof.

A boot is also employed by embodiments of the present invention that helps ensure that fluids, for example, are prevented from entering the building. Embodiments of the present invention employ a boot constructed of material suitable to seal the structure when in use and to provide weather resistance, e.g. ethylene propylene diene monomer (EPDM) rubber with UV protection. The hydrant support may also be fitted with flashing material to mask the hydrant support.

It is also envisioned that at least one shim may be included to facilitate interconnection between the hydrant support and the roof. Preferably, a two degree shim is employed that is placed under the hydrant support to help ensure that the hydrant support is generally oriented vertically. One skilled in the art, however, will appreciate that the flange that is associated with the hydrant support may be constructed of varying thicknesses to compensate for roof pitch.

It is another aspect of the present invention to provide a system for supporting a hydrant that is easy to install. More specifically, embodiments of the present invention allow for the interconnection of a hydrant to a roof via a hydrant support wherein the hydrant support and associated boot are separable and easily interconnect to the standpipe. In addition, it is contemplated that a flange be used in conjunction with the hydrant support that is located under the roof that is used to sandwich the roof between the flange of the hydrant support and the flange located beneath the roof. This under deck flange may be constructed of a single piece of material with a plurality of holes incorporated therein, thereby making it light and easy to install.

It is yet another aspect of the present invention to provide a tight seal between the standpipe and the hydrant support. When interfacing the standpipe to the hydrant support, a series of seals may be employed wherein the tightening of at least one bolt increases the compression on an intermediate seal, thereby squeezing it tightly between the standpipe and the inner diameter of the hydrant support. As alluded to above, the sealing system may be enhanced by the use of a boot that covers the seals and that interfaces with the standpipe and the outer diameter of the hydrant support.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
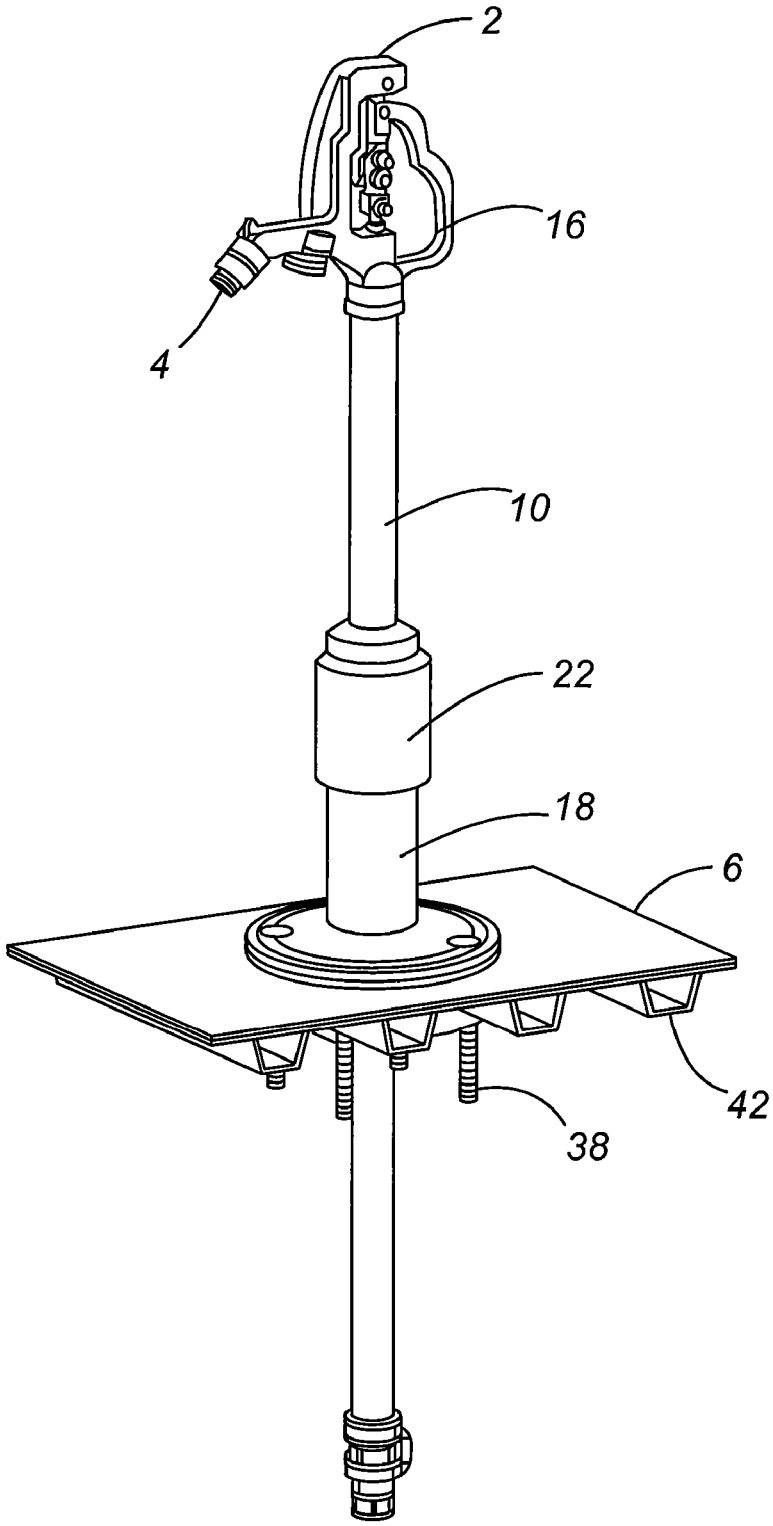
FIG. 1 is a perspective view of one embodiment of a hydrant roof mount.
Figure 2:
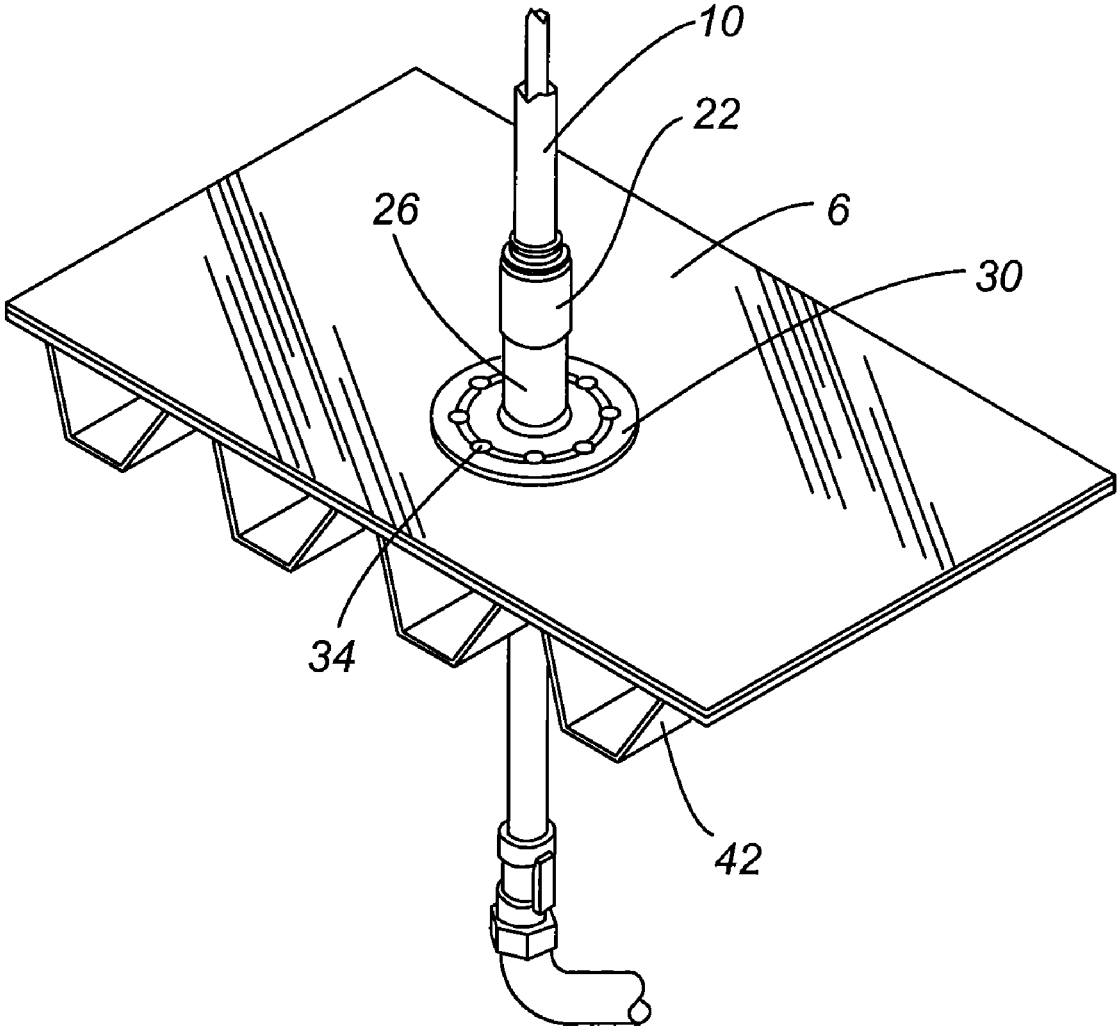
FIG. 2 is a partial perspective of one embodiment of the hydrant roof mount.

To assist in the understanding of the present invention the following list of components and associated numbering found in the drawings is provided herein:

| # | Components |
|---|---|
| 2 | Hydrant |
| 4 | Outlet |
| 6 | Roof deck |
| 10 | Standpipe |
| 14 | Water source |
| 16 | Handle |
| 18 | Hydrant support |
| 22 | Boot |
| 26 | Tube |
| 30 | Flange |
| 34 | Aperture |
| 38 | Mounting bolt |
| 42 | Roof underside |
| 46 | Under deck flange |
| 50 | Nut |
| 54 | Slot |
| 58 | Space |
| 62 | Shim |
| 66 | Boss |
| 70 | Screw |
| 74 | Washer |
| 78 | Lockwash |
| 82 | Cylindrical boot portion |
| 84 | Seal assembly |
| 86 | Upper well seal |
| 90 | Lip |
| 94 | Rubber seal |
| 98 | Bottom well seal |
| 102 | Bolt |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-12, a mounting system for securing a hydrant 2 to a roof deck 6 is provided. More specifically, embodiments of the present invention are used with a common hydrant 2 having a standpipe 10 that leads to a water supply 14. In the illustrated embodiment, the standpipe 10 is eventually interconnected to a water supply 14 that selectively is opened via a handle 16 of the hydrant 2. A hydrant support 18 provides rigidity to the standpipe 10. In order to ensure that substantially no fluid infiltrates into the inside of the building, a seal assembly 84, which includes an upper well seal 86, an intermediate seal 94, and a bottom seal 98, is employed that interfaces with the standpipe 10 and the hydrant support 18. A boot 22 may also be included to further provide leak resistance.

Referring now to FIGS. 1-6, the hydrant support of one embodiment of the present invention is shown that includes a tube 26 and a flange 30. Although shown herein, the tube 26 and flange 30 possess generally circular cross-sections, one skilled in the art will appreciate that any shape of tube 26 and flange 30 may be employed without departing from the scope of the invention. One purpose of the hydrant support 18 is to provide rigidity to the standpipe 14, thereby preventing angular motions of the standpipe 10 relative to the roof deck 6. In order to prevent air, moisture and other outside contaminants from entering the building between any gaps that may exist between the standpipe 10 and the tubular portion 26 of the hydrant support 18, a boot 22 is provided. The boot 22 is positioned on the standpipe 10 and the tube 26 of the hydrant support 18. The flange 30 of the hydrant support 18 includes a plurality of apertures 34 that define a hole pattern for receipt of mounting bolts 38 that help ensure a rigid interconnection between the hydrant support 18 and the roof deck 6.

Figure 3:
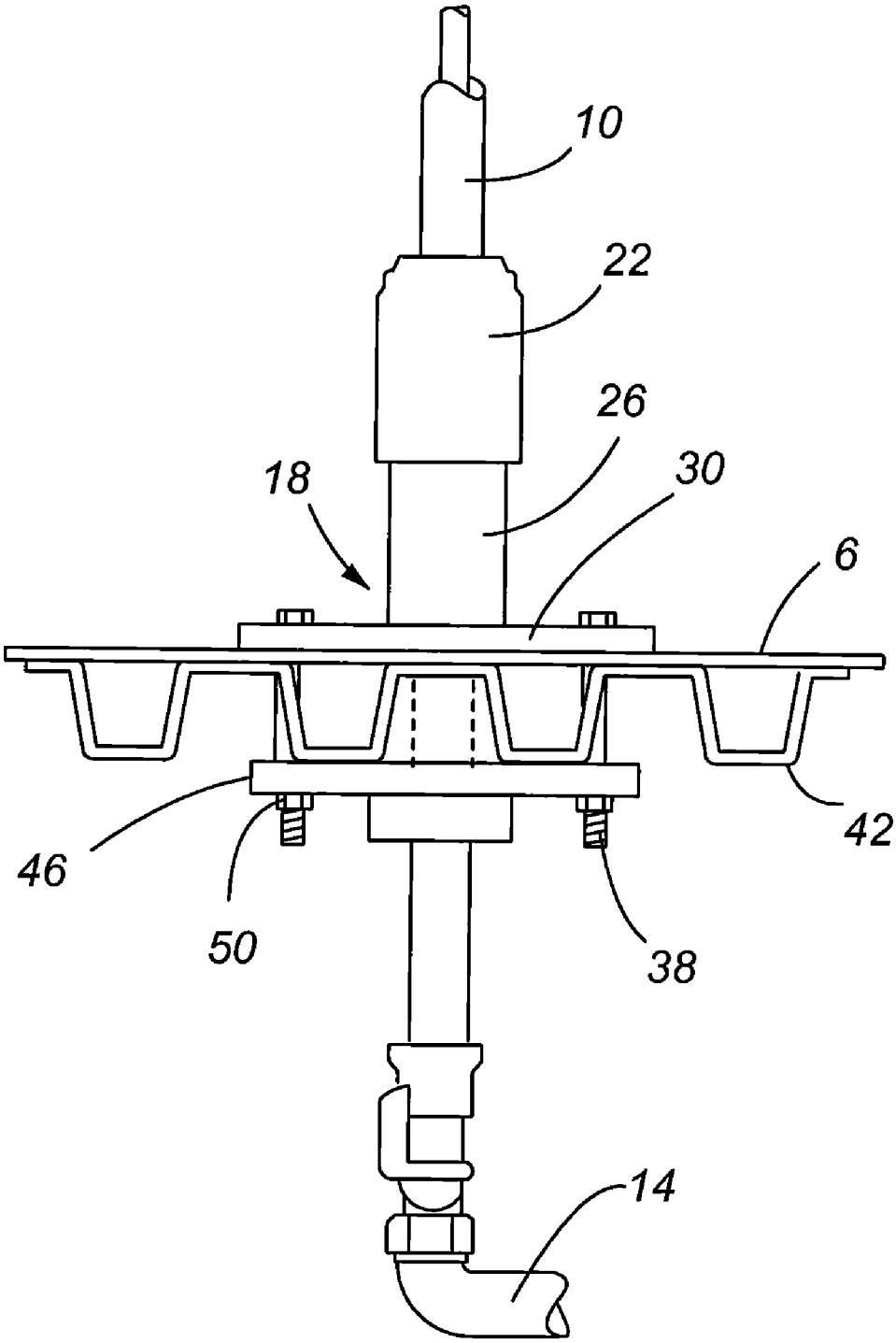
FIG. 3 is a front elevation view of the hydrant roof mount shown in FIG. 2.
Figure 4:
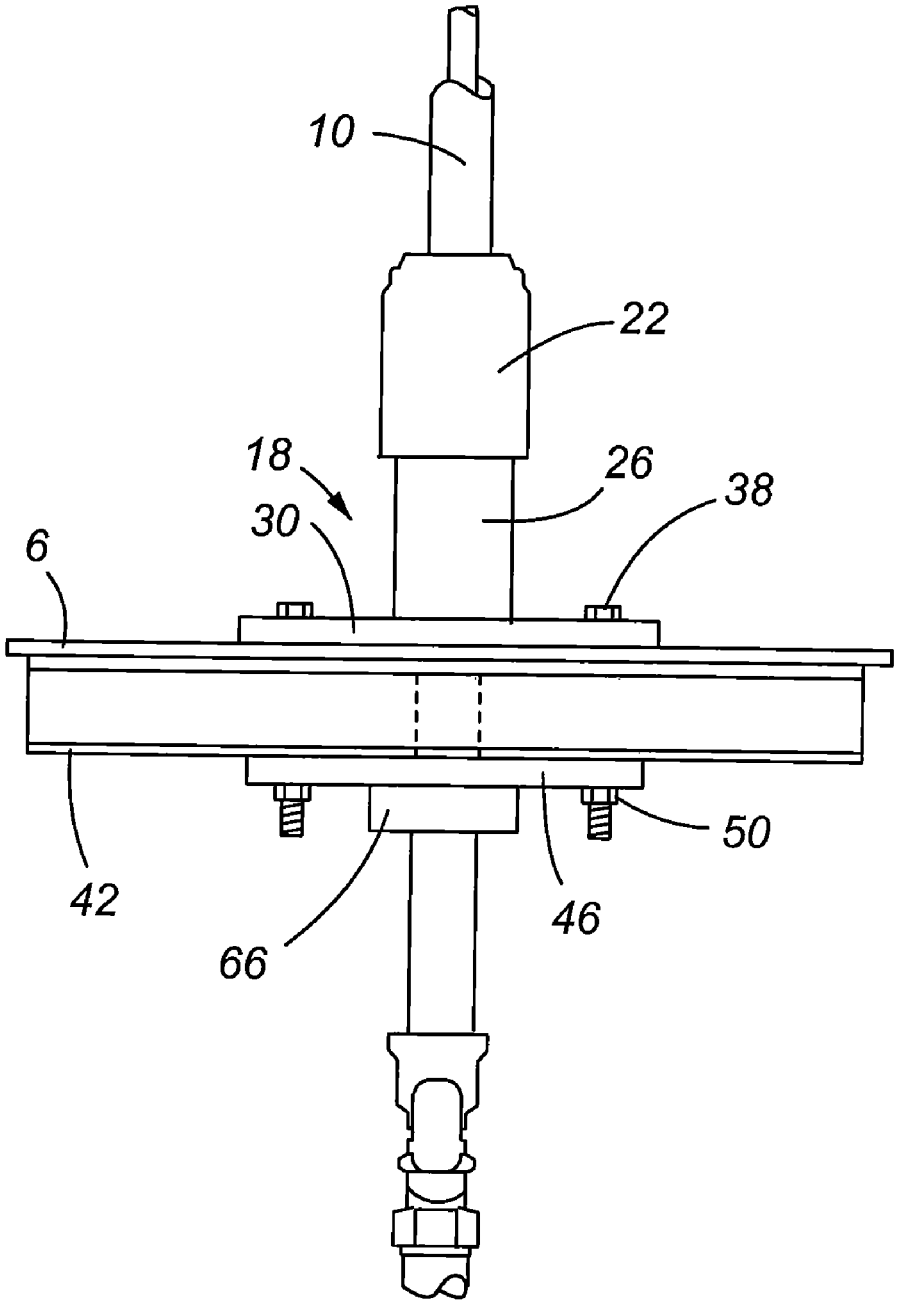
FIG. 4 is a left elevation view of the hydrant roof mount shown in FIG. 2.

With specific reference to FIGS. 3 and 4, interconnection of the hydrant support 18 is preferably achieved via the plurality of mounting bolts 38 that are placed through the apertures 34 of the flange 30, through the roof deck 6 and a roof underside 42 (which may include a plurality of corrugations) and through an under deck flange 46. The roof deck 6 and the roof underside 42 are thus sandwiched between the flange 30 of the hydrant support 18 and the under deck flange 46 and held in place via a plurality of nuts 50 that are interconnected to the mounting bolts 38. As will be described in further detail below, after the hydrant support 18 is interconnected to the roof deck 6, the standpipe 10 and associated hydrant 2 are placed within an inner diameter of the tube 26 and interconnected to the water supply 14. The boot may also be associated with the standpipe 10, thereby obstructing any gaps between the standpipe 10 and the tube 26.

Referring now to FIG. 5, various views of alternative interconnection schemes are shown. More specifically, one skilled in the art will appreciate that, although a tube 26 interconnected to a flange 30 is shown in an upright position other interconnection methods may be contemplated by embodiments of the present invention. For example, as shown in FIG. 5A, the tube is omitted entirely, wherein the standpipe 10 is associated with the flange 30 and the under deck flange 46. This interconnection scheme allows for added stability to the standpipe 10 since it is held in at least two positions. However, the added benefit of the tube is omitted, thereby reducing the stability of the hydrant from that shown in FIG. 3. One skilled in the art will appreciate that various seals may also be included with the flanges 30 and 46 to reduce the chances of leaking.

Figure 5A:
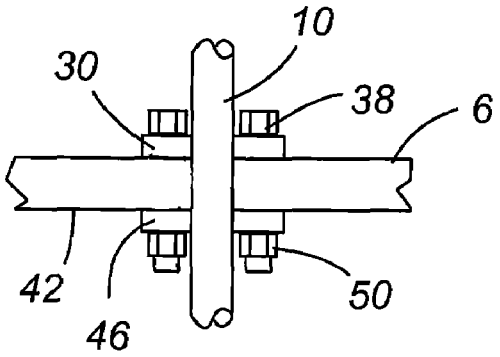
FIG. 5 are partial front elevation views of alternative configurations of the hydrant roof mount.
Figure 5B:
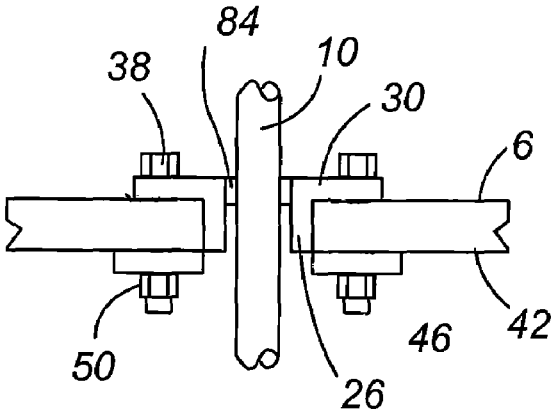

Referring now to FIG. 5B, another method of interconnecting the hydrant mount to a roof deck 6 is shown. Here, the system of FIG. 3 is inverted wherein the tube 26 is positioned within the roof. The remainder of the mount is similar to that shown in FIG. 3, wherein the under deck flange 46 is used in conjunction with a flange 30 of the hydrant support to provide the necessary structure to hold the standpipe in place. The seal assembly 84 is also included that interconnects the tube to the standpipe 10.

Figure 5C:
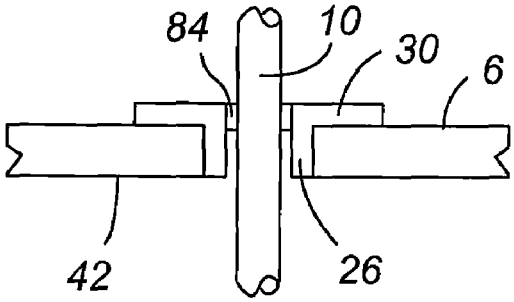

Referring now to FIG. 5C, yet another interconnection method is shown that is very similar to FIG. 5B. More specifically, in this configuration, the under deck flange is omitted wherein the seal assembly 84 provides most of the structural support to the standpipe 10.

Figure 5D:
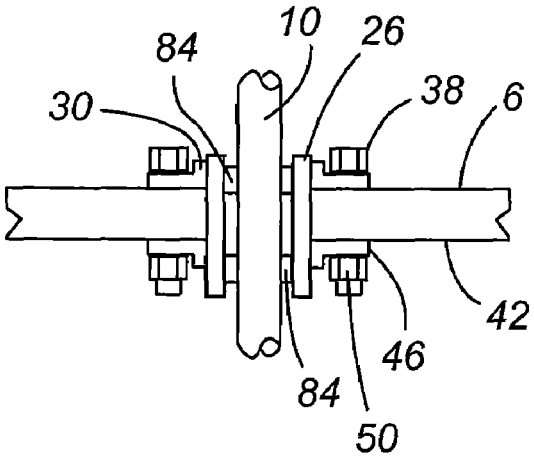

Referring now to FIG. 5D, yet another interconnecting method is shown wherein an elongated tube is provided. The tube 26 is designed to extend above the roof deck 6 and below the roof underside 42. However, one skilled in the art will appreciate that the tube 26 may extend in only one direction. The tube 26 is held in place via the flange 30 and the under deck flange 46, which are interconnected via a plurality of mounting bolts 38 and associated nuts 50. The standpipe 10 is affixed within the tube 26 by at least one seal assembly 84. Here it is shown that the flange 30 and the tube 26 are separable elements. This concept can be carried on to the embodiment shown in FIG. 3 as well. In addition, one skilled in the art will appreciate that the seal assembly 84, the tube 26, the flange 30 and the under deck flange 46 of any of the embodiments contemplated herein may be made of a one or more pieces such as a clamshell configuration that maybe used with sealing elements such as o-rings to facilitate assembly.

Figure 6:
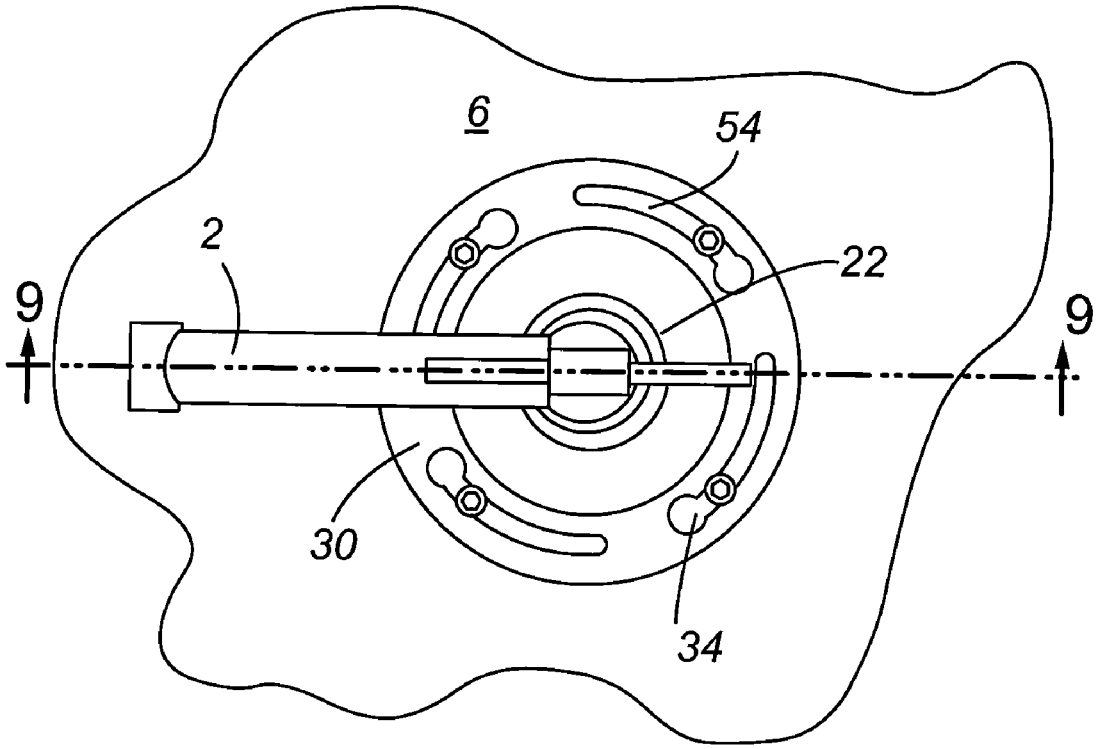
FIG. 6 is a top plan view of the hydrant roof mount shown in FIG. 2.
Figure 7:
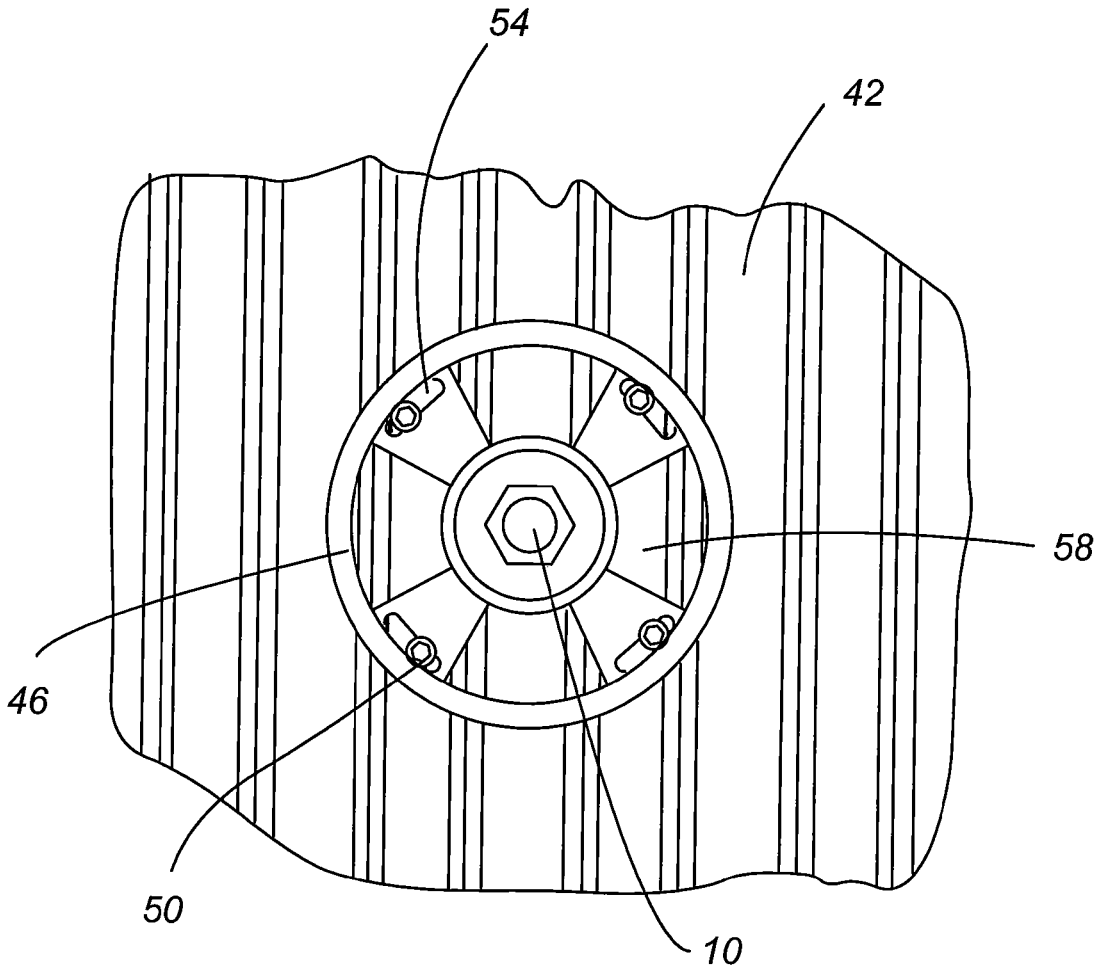
FIG. 7 is a bottom plan view of the hydrant roof mount shown in FIG. 2.

Referring now specifically to FIGS. 6 and 7, the hydrant support flange 30 and the under deck flange 46 is shown. More specifically, of some embodiments so the present invention, the flange 30 employs a plurality of about ¾ inch diameter apertures 34 positioned approximately in an 8 inch bolt circle. One skilled in the art will appreciate, however, that the flange 30 may possess any shape, be any size and have apertures of any size and number. In addition, each aperture 34 may be associated with a slot 54 that allows for adjustments of the hydrant support 18 prior to rigid interconnection of the hydrant support 18 to the roof deck 6. Preferably, the flange 30 employs hex-shaped countersunk holes that allow an individual installer to mate the under deck flange 46 with the mounting bolts 38 without having to secure the mounting bolt heads at the same time. The under deck flange 46 may include a plurality of weight-reducing spaces 58 that allow for easier interconnection to the mounting bolts 38. The under deck flange 46 may also include a plurality of slots 54 to allow for rotational alignment of the under deck flange 46 with respect to the hydrant support flange 30. As one of skill in the art will appreciate, the under deck flange 46 may be omitted wherein the nuts 50 interface with the mounting bolts 38 and abut the roof underside 42.

Figure 8:
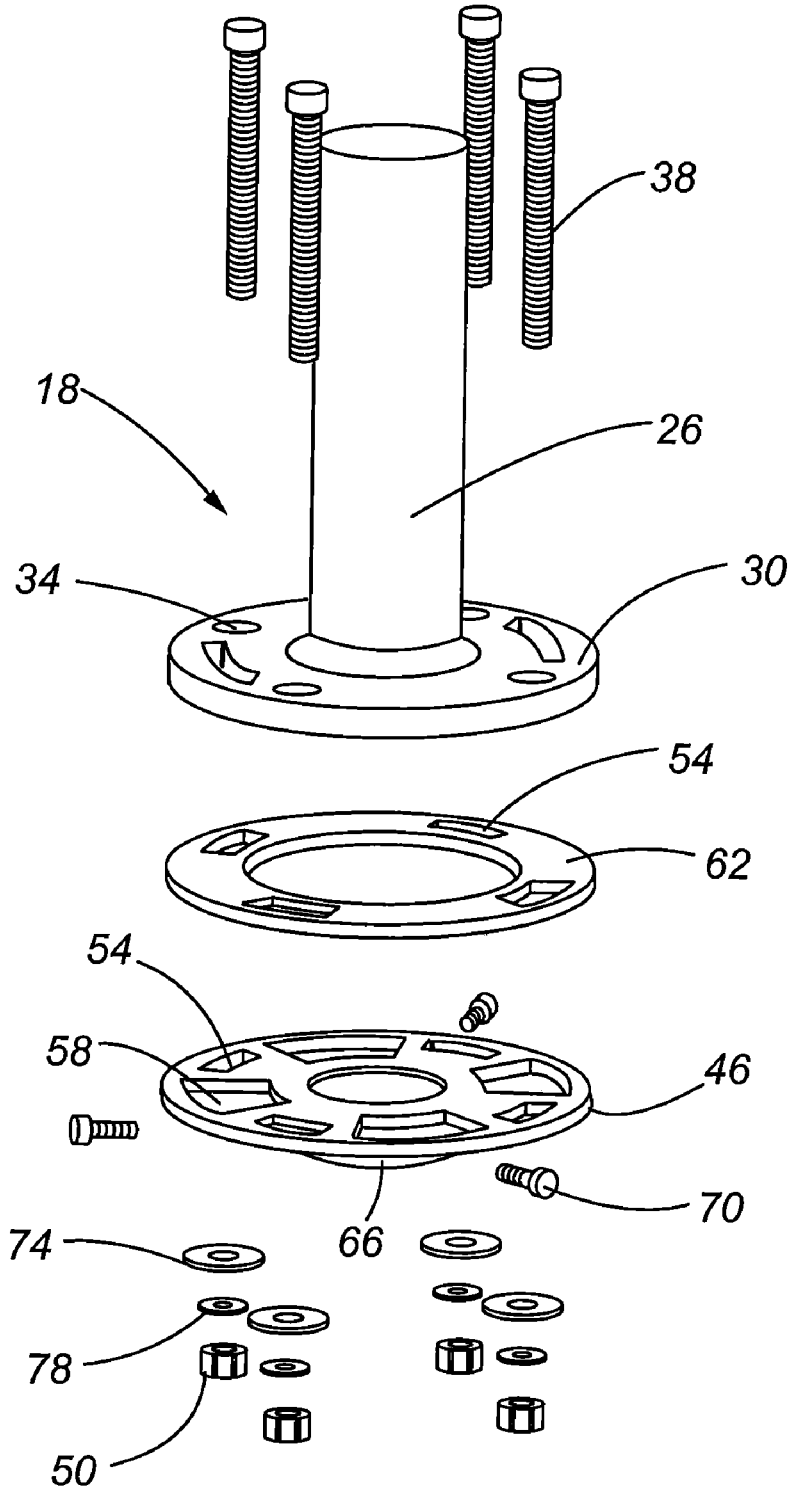
FIG. 8 is an exploded view showing components associated with a hydrant support of one embodiment of the present invention.

Referring now to FIG. 8, an exploded perspective view of the hydrant support 18 of one embodiment of the present invention is shown. Here, the hydrant support 18 includes the hollow cylindrical tube 26 interconnected to the flange 30 having four apertures 34 in a previously described hole pattern. The hydrant support 18 is preferably constructed of cast iron, however, it is contemplated that other similar rigid materials may be employed without departing from the scope of the invention. According to embodiments of the present invention, the tube is preferably about 11.25 inches long and the flange has a diameter of about 10 inches. Again, those skilled in the art will appreciate that the tube and flange may be any size. When interconnecting the flange 30 to the roof deck 6, a shim 62 may be employed, which also may include slotted apertures 54, to help ensure that the tube 26 is oriented generally vertical. The shim 62 preferably possesses an angle of about two degrees, however, it is foreseeable that shims 62 of other angles may be employed without departing from the scope of the invention. The under deck flange 46 is shown having a plurality of spaces 58 to decrease its weight. The under deck flange 46 may also include a boss 66 emanating therefrom that provides a location for a plurality of screws 70. In operation, the screws 70 interface with the standpipe 10 to enhance angular and vertical rigidity. As one skilled in the art will appreciate, a plurality of washers 74, lock washers 78 and nuts 50 are used in conjunction with the mounting bolts 38.

Figure 9:
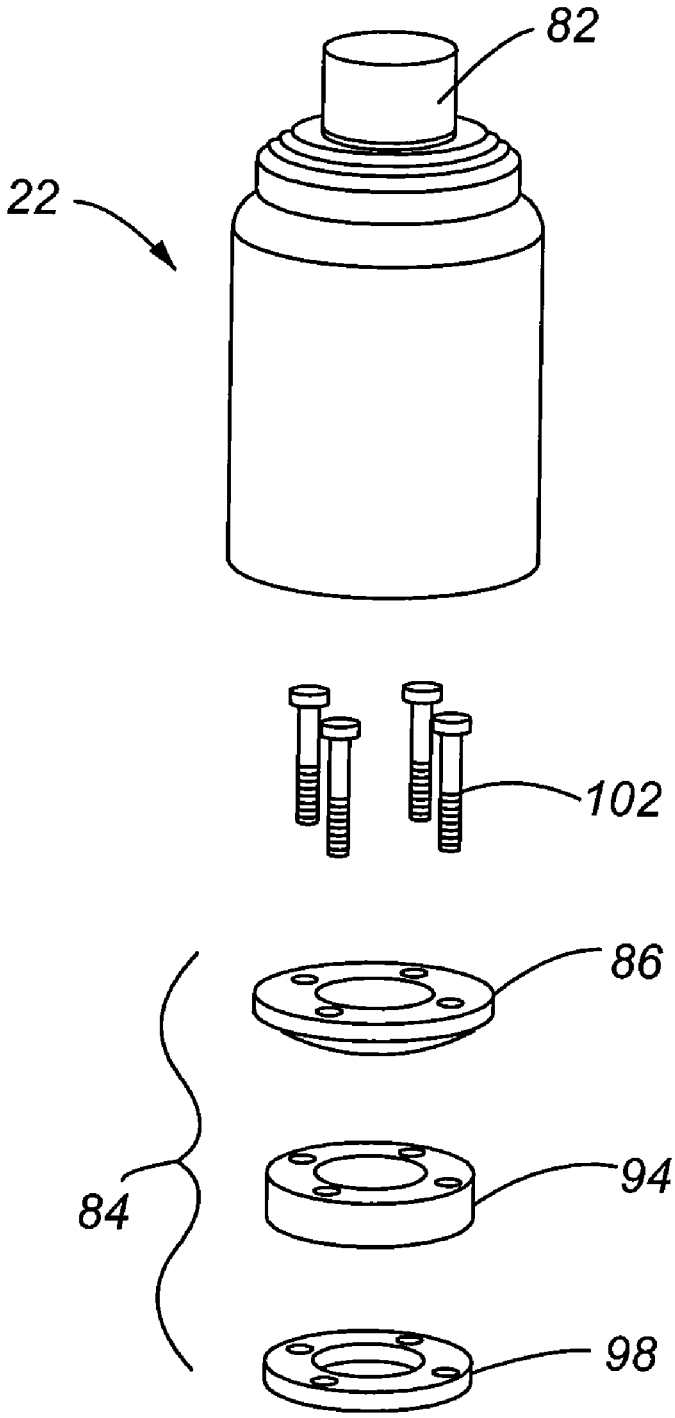
FIG. 9 is an exploded view showing a boot of one embodiment of the present invention with associated seals and hardware.
Figure 10:
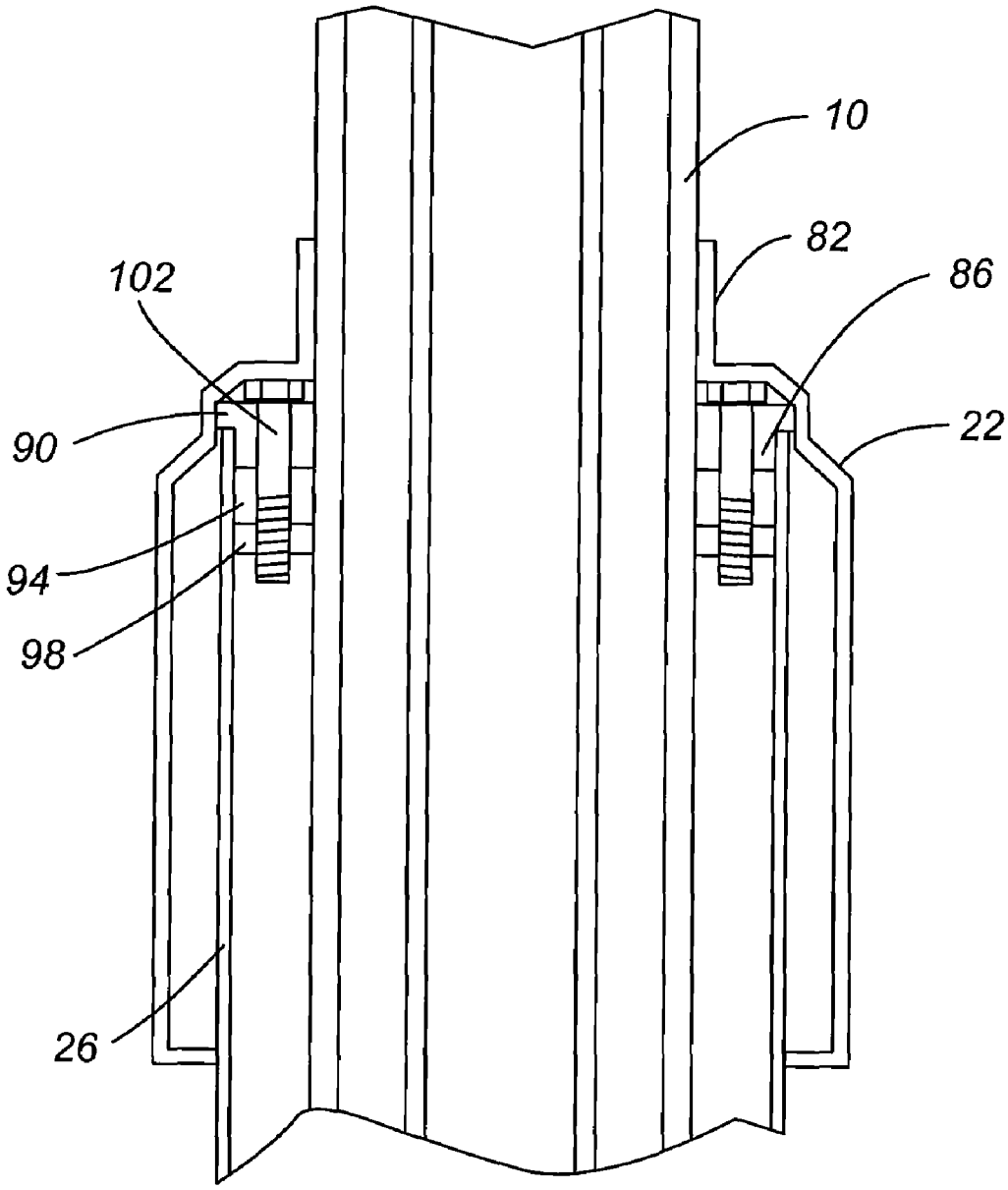
FIG. 10 is a cross sectional view of FIG. 5.

Referring now to FIGS. 9 and 10, the boot 22 and associated hardware used to connect the boot 22 to the hydrant support 18 is provided. More specifically, the boot 22 of embodiments of the present invention includes a cylindrical portion 82 that is associated with the standpipe 10 and a larger diameter portion that is associated with the tube 26 of the hydrant support 18. As shown herein, the boot 22 is comprised of a plurality of circumferential and/or conical sections, however, one skilled in the art will appreciate that the boot may include various individual interconnected pieces and may be of any shape that generally prevents fluids or other items from entering between the standpipe 10 and the tube 26. Preferably, the boot is made of EPDM and has at least some ultraviolet protection, thereby maximizing the life of the boot material.

Figure 11:
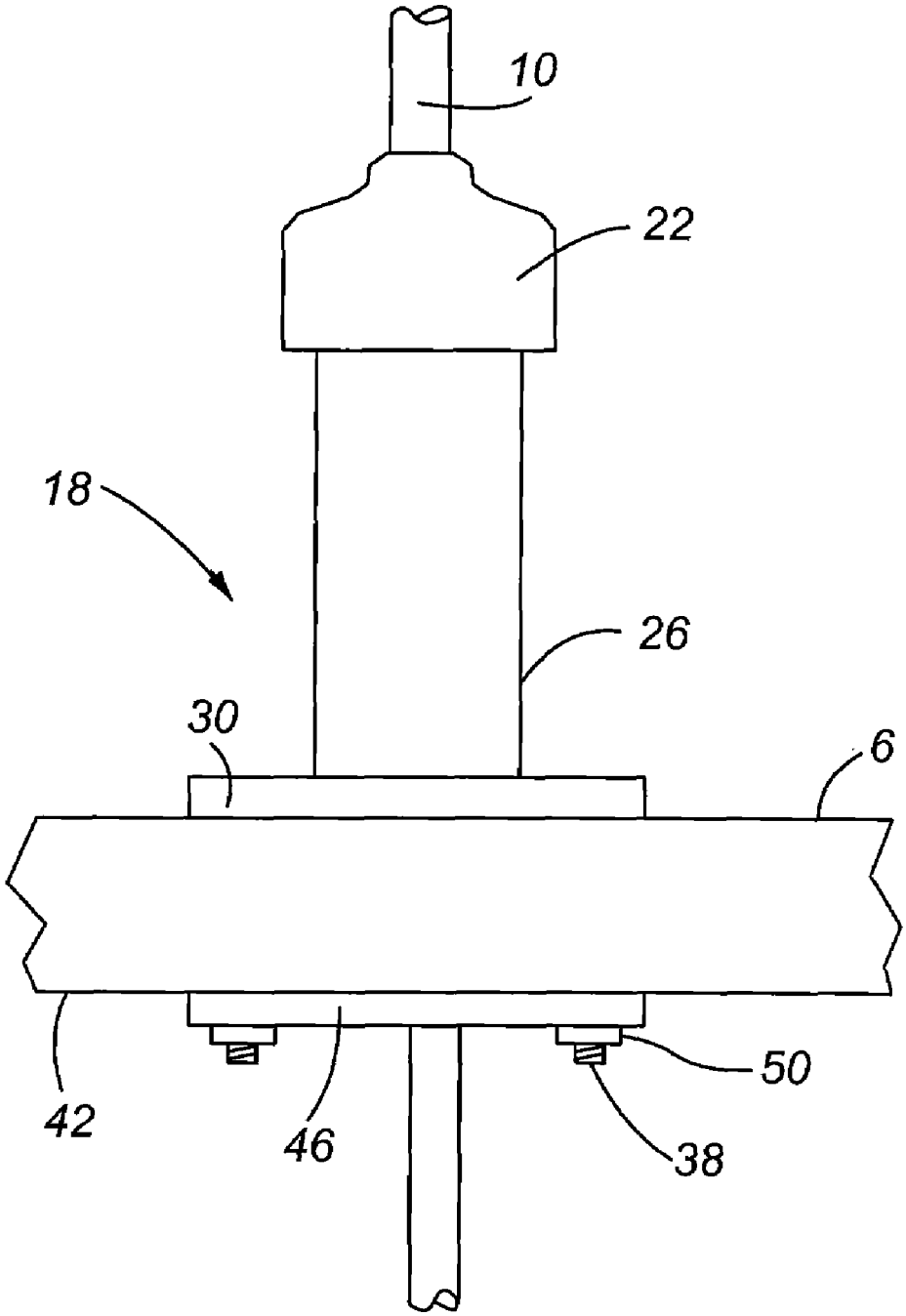
FIG. 11 is a front elevation view of an alternative embodiment of a boot.
Figure 12:
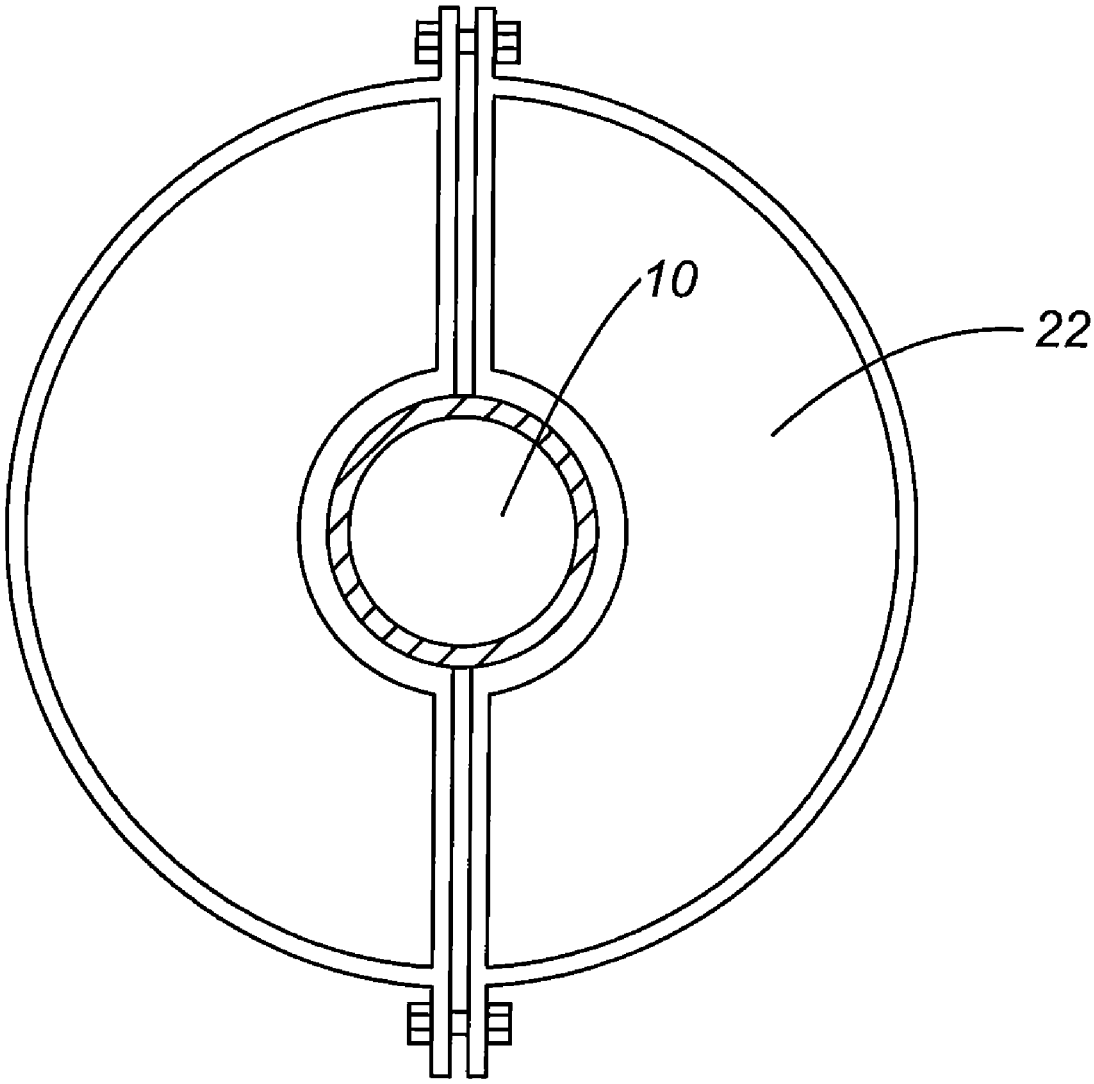
FIG. 12 is a top plan view of FIG. 11.

Referring now to FIGS. 11 and 12, another embodiment of the boot is shown. As one skilled in the art will appreciate, boots as contemplated herein can be configured in a variety of shapes and sizes. Here, the boot 22 is similar to that described above, however it is more succinctly described as a cap that blocks the seal assembly. Assemblage of the boot, as described in more detail below is also very similar to that described above. With specific reference to FIG. 12, the concept of a multiple pieced boot is shown. Here, the boot is comprised of two separable pieces that are clam shelled around the standpipe 10 and interconnected. Interconnection can be achieved by adhesives, fasteners, a snap fit (which may be integrally molded into the boot halves), tying, or any other similar method. One skilled in the art will appreciate that the boot may be comprised of two or more pieces, thereby facilitating interconnection of the boot 22 to the hydrant assembly in the field. As shown in FIG. 10, embodiments of the present invention employ an upper well seal 86 having a lip 90 for interconnection to the upper end of the tube 26. Beneath the upper well seal 86, preferably a rubber seal 94 is located that is followed by a bottom well seal 98. The bottom well seal 98 also includes a threaded inner diameter such that a bolt 102 is used to interconnect all three seals. The upper cylindrical portion 82 of the boot 22 is then slid down on the assemblage of seals to complete the sealing system. The remaining portion of the boot 22 then drapes over the bolts 102 and seals and engages the tube 26. Thus, a system is provided where fluids, air, smoke, or other outside contaminants are prevented from infiltrating into the space between the tube 26 of the hydrant support 18.

Referring now again to FIGS. 1-12, the roof mounting system of embodiments of the present invention is shipped in a kit that preferably includes a pre-assembled hydrant assembly, with seal assembly 84 and boot 22 interconnected thereto, along with the hydrant support 18 and associated hardware. Alternatively, the kit may just include the seal assembly 84, hydrant support 18, boot 22 and associated hardware for retrofitting existing hydrant mountings. To install the hydrant support 18 of one embodiment the hole pattern of the hydrant support flange 30 is initially used to provide locations for drilling the mounting bolt 38 holes through the roof deck 6 and the roof underside 42. The tube 26 of the hydrant support is also used to locate the standpipe penetration. More specifically, the installer places the hydrant support 18 on top of the roof deck 6 and assess the need for any shimming. If, in fact, shimming is required, the proper shim(s) may be placed upon the roof deck 6 along with the hydrant support to ensure that the hydrant support 18 will be aligned generally vertically after installation. Next, the location of the mounting holes and the hole that accommodates the standpipe 10 are marked. The hydrant support 18 and associated shims 62 are then removed and the appropriate holes are drilled into the roof deck 6 and through the roof deck under surface 42. The hydrant support 18 and associated shims 62 are then placed over the hole and a plurality of mounting bolts 38 are then threaded through the apertures of the flange 30, through the apertures of any shims included, through the roof deck 6 and through the roof deck underside 42. The under deck flange 46 is then brought up and interconnected to the mounting bolts 38 via a plurality of washers 70 and 74 and nuts 50. Finally, a plurality of screws 70 are used that interface with threaded holes in the boss 66 that protrudes from the under deck flange 46, thereby generally preventing rotation and translation of the standpipe. Instead of screws 70, another seal assembly 84 can be used to interface the standpipe 10 with the boss 66 or a clamp or bracket may be employed to interconnect the standpipe 10 with the under deck flange 46. For example, a split ring with or without seals is contemplated.

After the hydrant support 18 is located, the installer inserts the standpipe 10 (with the associated seal assembly 84 positioned toward the hydrant 2) through the tube 26 of the hydrant support 18. The upper well seal 86, rubber seal 94 and associated well seal 98 are then slid between the standpipe 10 and the hydrant support 18. One skilled in the art will appreciate that the seal assembly 84 may alternatively be clam shelled around the standpipe 10 to facilitate on site interconnection and retrofitting. It is important to note the amount of standpipe 10 exposed out of the hydrant support 18 may be selectively altered in the vertical direction at this time. Once the desired height of the hydrant 2 is achieved, the other end of the standpipe 10 is interconnected to the water supply 14. The seal assembly 84, which includes the upper well seal 86, the rubber seal 94 and the bottom well seal 98, is then tightened via the bolts 102 such that the lower well seal 98 is drawn upward towards the upper well seal 86, thereby bulging the rubber seal 94 to form a tight seal between the standpipe 10 and the tube 26.

At this time, roofing material may be integrated around the hydrant support 18. For example, flashing, a weather proofing shielding used to prevent intrusion of water into buildings, may be wrapped around the tube 26 of the hydrant support 18. Roof flashing is often placed around discontinuities or objects which protrude from the roof of a building to deflect water away from seams or joints. Here, one skilled in the art will appreciate that all sealing methods generally used to accommodate other roof protrusions may be used in conjunction with embodiments of the present invention.

The optional boot 22, which was previously located near the hydrant 2 is then slid onto the standpipe 10 and associated with the tubular portion of the hydrant support 18. Boots 22 of alternative embodiments that possess multiple pieces could, of course, be integrated onto the hydrant support 18 at any time. Some boots 22 contemplated herein are designed to be easily movable away from the hydrant support 18 or removed from the hydrant support 18 to allow selective access to the seal assembly bolts 102, thereby allowing quick access to the seal assembly 84 for servicing and/or replacement. Finally, the standpipe 10 is interconnected to the hydrant 2 at one end and the water supply 14 on the other end.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. In addition, one skilled in the art will appreciate that aspects of other inventions may be incorporated in or added in combination to the embodiments of the present invention disclosed herein. For example, aspects of inventions disclosed in U.S. Patent and Published Patent Application Nos. 5,632,303, 5,590,679, 7,100,637, 5,813,428, and 20060196561, all of which being incorporated by reference herein, which concern backflow prevention may be incorporated into embodiments of the present invention. Aspects of inventions disclosed in U.S. Pat. Nos. 5,701,925 and 5,246,028, all of which being incorporated by reference herein, which concern sanitary hydrants may be incorporated into embodiments of the present invention. Aspects of inventions disclosed in U.S. Pat. Nos. 6,532,986, 6,805,154, 6,135,359, 6,769,446, 6,830,063, RE39,235, 6,206,039, 6,883,534, 6,857,442 and 6,142,172, all of which being incorporated by reference herein, which concern freeze-proof hydrants may be incorporated into embodiments of the present invention. Aspects of inventions disclosed in U.S. Patent and Published Patent Application Nos. U.S. Pat. Nos. D521,113, D470,915, 7,234,732, 7,059,937, 6,679,473, 6,431,204, 7,111,875, D482,431, 6,631,623, 6,948,518, 6,948,509, 20070044840, 20070044838, 20070039649, 20060254647 and 20060108804, all of which being incorporated by reference herein, which concern general hydrant technology may be incorporated into embodiments of the present invention.

What is claimed is:

1. A roof mount for a hydrant, which includes a standpipe, comprising:

a hydrant support having a first flange with a tube extending therefrom;

a second flange for spaced interconnection to said first flange via at least one mounting bolt; and a sealing system positioned within said tube adapted for engagement to a standpipe, said sealing system including an upper seal that is interconnected to a lower seal with an intermediate seal therebetween via at least one bolt, wherein tightening said bolt generates a bulge in said intermediate seal.

2. The roof mount for a hydrant of claim 1, wherein said first flange and said second flange include at least one aperture that receives said at least one mounting bolt.

3. The roof mount for a hydrant of claim 2, wherein said at least one aperture of said first flange and said second flange are associated with a slot.

4. The roof mount for a hydrant of claim 1, wherein said first flange has varied thickness to accommodate a pitch angle of a roof to which said first flange is to be interconnected.

5. The roof mount for a hydrant of claim 1, further comprising a shim for engagement to said first flange to alter a pitch angle of a roof to which said first flange is to be interconnected.

6. The roof mount for a hydrant of claim 1, further including a boot adapted for association with a standpipe and for engagement to said tube.

7. A device for mounting a hydrant, comprising:

a means for supporting having a means for mating with a means for stabilizing extending therefrom;

a flange for spaced interconnection to said means for mating via at least one means for fastening; and a means for sealing positioned within said means for stabilizing adapted for engagement with an standpipe, said means for sealing including an upper seal that is interconnected to a lower seal with an intermediate seal therebetween via at least one bolt wherein tightening said bolt bulges said intermediate seal.

8. The device of claim 7, wherein said means for mating has varied thickness to accommodate a pitch angle of a surface to which said means for mating is to be interconnected to.

9. The device of claim 7, further comprising a shim for engagement to said means for mating that helps accommodate a pitch angle of a surface to which said first flange is to be interconnected to.

10. The device of claim 7, further including a boot adapted for association with the standpipe and for engagement to said means for stabilizing.

11. The device of claim 7, wherein said means for mating is at least one of a flange, a bracket and a plate.

12. A fluid hydrant for interconnection to a roof of a structure having a roof deck and a roof underside, comprising:

a hydrant support having a flange with a tube extending therefrom, said flange adapted to engage the roof deck;

an under deck flange adapted for engage the roof under side;

a plurality of mounting bolts that interconnect said flange and said under deck flange wherein the roof deck and the roof underside is positioned therebetween;

a standpipe positioned within said tube;

a sealing system positioned between said tube and said standpipe; and a hydrant interconnected to said standpipe.

13. The fluid hydrant of claim 12, wherein said under deck flange includes a boss extending therefrom that receives at least one screw that interfaces with said standpipe.

14. The fluid hydrant of claim 12, further comprising a shim for engagement to said flange that helps accommodate a pitch angle of a roof to which said flange is to be interconnected to.

15. The fluid hydrant of claim 12, wherein said sealing system includes an upper seal that is interconnected to a lower seal with an intermediate seal therebetween via at least one bolt wherein tightening said bolt bulges said intermediate seal.

16. The fluid hydrant of claim 12, further including a boot for interconnection to the standpipe and said tube.

17. A method of affixing a hydrant to a roof comprising:

placing a hydrant support having a flange with a plurality of holes and a hollow tube extending therefrom onto a roof deck of a structure;

using said hydrant support to locate a hole pattern;

drilling mounting holes through the roof deck and the under side of the roof;

cutting a hole to receive a standpipe of the hydrant into the rook deck;

placing mounting bolts through the hydrant support, the roof deck and the under side of the roof;

engaging an under deck flange onto the underside of the roof such that said mounting bolts are placed therethrough;

interconnecting nuts to said mounting bolts, thereby securely interconnecting said hydrant support to a roof;

placing said standpipe into said hydrant support; and placing a sealing system between said standpipe and said hydrant support.

18. The method of claim 17, wherein said under deck flange includes a boss extending therefrom and further comprising fastening at least one screw that interfaces with said standpipe.

19. The method of claim 17, further comprising adding a shim between said flange and said roof deck to accommodate a pitch angle of the roof.

20. The method of claim 17, wherein said sealing system includes an upper seal that is interconnected to a lower seal with an intermediate seal therebetween via at least one bolt wherein tightening said bolt bulges said intermediate seal.

21. The method of claim 17, further including a boot for interconnection to the standpipe and said tube.

22. A roof mount for a hydrant, which includes a standpipe, comprising:

a hydrant support having a first flange with a tube extending therefrom;

a second flange for spaced interconnection to said first flange via at least one mounting bolt;

a sealing system positioned within said tube adapted for engagement to the standpipe; and a boot adapted for association with the standpipe and for engagement to said tube.

23. A device for mounting a hydrant, comprising:

a means for supporting having a means for mating with a means for stabilizing extending therefrom;

a flange for spaced interconnection to said means for mating via at least one means for fastening;

a means for sealing positioned within said means for stabilizing adapted for engagement with a standpipe; and a boot adapted for association with the standpipe and for engagement to said means for stabilizing.

* * * * *